US012312893B2

(12) United States Patent
Brattebø et al.

(10) Patent No.: US 12,312,893 B2
(45) Date of Patent: May 27, 2025

(54) METHODS FOR INSTALLING RISERS IN A FLUID INJECTION SYSTEM

(71) Applicant: HORISONT ENERGI AS, Sandnes (NO)

(72) Inventors: Ståle Brattebø, Tananger (NO); Bjørgulf Haukelidsæter Eidesen, Stavanger (NO)

(73) Assignee: HORISONT ENERGI AS (NO)

( * ) Notice: Subject to any disclaimer, the term of this patent is extended or adjusted under 35 U.S.C. 154(b) by 0 days.

(21) Appl. No.: 18/284,652

(22) PCT Filed: Mar. 29, 2022

(86) PCT No.: PCT/EP2022/058328
§ 371 (c)(1),
(2) Date: Sep. 28, 2023

(87) PCT Pub. No.: WO2022/207668
PCT Pub. Date: Oct. 6, 2022

(65) Prior Publication Data

US 2024/0368947 A1 Nov. 7, 2024

(30) Foreign Application Priority Data

Mar. 29, 2021 (EP) ..... 21165680

(51) Int. Cl.
*E21B 17/01* (2006.01)
*B63B 35/44* (2006.01)
(Continued)

(52) U.S. Cl.
CPC ..... *E21B 31/03* (2013.01); *B63B 35/4413* (2013.01); *E21B 17/01* (2013.01);
(Continued)

(58) Field of Classification Search
CPC ..... E21B 17/02; E21B 33/0355; E21B 43/013
See application file for complete search history.

(56) References Cited

U.S. PATENT DOCUMENTS 4,367,055 A * 1/1983 Gentry ..... B63B 22/021 166/359
5,803,161 A 9/1998 Wahle et al.
(Continued)

FOREIGN PATENT DOCUMENTS

GB 2090222 A 7/1982
WO 9324733 12/1993
(Continued)

OTHER PUBLICATIONS

International Search Report issued in PCT Application No. PCT/EP2022/058328, mailed Jul. 7, 2022.
(Continued)

*Primary Examiner* — Taras P Bemko
(74) *Attorney, Agent, or Firm* — Dilworth IP, LLC

(57) ABSTRACT

A riser to be arranged for injecting fluid from a vessel on a water surface into a subterranean void beneath a seabed is attached to a buoy according to the following method. The remotely operated vehicle is controlled to attach a winch wire to a head end of the riser. The ROV is then controlled to lead the winch wire via the buoy to a winch unit on a seabed below the buoy. Thereafter, the winch unit is controlled to pull up the head end of the riser to a bottom side of the buoy. Finally, the ROV is controlled to connect the head end of the riser to a connector arrangement in the bottom of the buoy.

6 Claims, 5 Drawing Sheets

(51) Int. Cl.

| | |
|---|---|
| ***E21B 17/02*** | (2006.01) |
| ***E21B 31/03*** | (2006.01) |
| ***E21B 33/035*** | (2006.01) |
| ***E21B 36/00*** | (2006.01) |
| ***E21B 43/013*** | (2006.01) |

(52) U.S. Cl.
CPC ..... *E21B 17/02* (2013.01); *E21B 33/0355* (2013.01); *E21B 36/00* (2013.01); *E21B 43/013* (2013.01)

(56) References Cited

U.S. PATENT DOCUMENTS

| | | | | |
|---|---|---|---|---|
| 8,202,023 | B2 * | 6/2012 | Millheim | E21B 17/012 405/169 |
| 9,435,185 | B2 * | 9/2016 | Wright | F04C 2/16 |
| 9,631,438 | B2 | 4/2017 | McKay | |
| 9,784,044 | B2 | 10/2017 | Persent et al. | |
| 9,982,518 | B2 | 5/2018 | Seguin et al. | |
| 2002/0028070 | A1 | 3/2002 | Holen | |
| 2003/0106714 | A1 * | 6/2003 | Smith | E21B 19/22 114/244 |
| 2003/0159581 | A1 * | 8/2003 | Sanderford | E21B 43/36 95/254 |
| 2003/0170077 | A1 | 9/2003 | Herd et al. | |
| 2003/0188873 | A1 * | 10/2003 | Anderson | E21B 43/40 166/357 |
| 2006/0140726 | A1 | 6/2006 | Pollack et al. | |
| 2008/0135258 | A1 | 6/2008 | Daniel et al. | |
| 2010/0032164 | A1 | 2/2010 | Bakke | |
| 2010/0051279 | A1 | 3/2010 | Baugh et al. | |
| 2011/0017465 | A1 | 1/2011 | Wales et al. | |
| 2011/0088910 | A1 | 4/2011 | Mccann et al. | |
| 2012/0085544 | A1 | 4/2012 | Shilling et al. | |
| 2012/0273213 | A1 | 11/2012 | Blalock et al. | |
| 2014/0318791 | A1 | 10/2014 | Mancini et al. | |
| 2015/0345274 | A1 | 12/2015 | Sathananthan et al. | |
| 2016/0102531 | A1 | 4/2016 | Keinath et al. | |
| 2016/0290070 | A1 | 10/2016 | Kristoffersen et al. | |
| 2017/0051589 | A1 | 2/2017 | Seguin et al. | |
| 2019/0162336 | A1 | 5/2019 | Andersen et al. | |
| 2019/0195062 | A1 | 6/2019 | Espe et al. | |
| 2023/0040253 | A1 | 2/2023 | Fiorenza De Lima | |
| 2023/0123313 | A1 | 4/2023 | Leforgeais et al. | |

FOREIGN PATENT DOCUMENTS

| | | | |
|---|---|---|---|
| WO | 03086976 | A2 | 10/2003 |
| WO | 2003086976 | A3 | 10/2003 |
| WO | 2004/007910 | A1 | 1/2004 |
| WO | 2021/122686 | A1 | 6/2021 |

OTHER PUBLICATIONS

Shi, J-Q, et al.; "Snøhvit CO2 storage project: Assessment of CO2 injection performance through history matching of the injection well pressure over a 32-months period", Energy Procedia 37 (2013) 3267-3274.

Eiken, O., et al.; "Lessons Learned from 14 years of CCS Operations: Sleipner, In Salah and Snøhvit", Energy Procedia 4 (2011) 5541-5548.

Haugen, H. A .; et al., "13th International Conference on Greenhouse Gas Control Technologies, GHGT-13, Nov. 14-18, 2016, Lausanne, Switzerland Commercial capture and transport of CO2 from production of ammonia", Energy Procedia 114 (2017) 6133-6140.

European Search Report, EP Patent Application No. 21165680.6 dated Sep. 2, 2021.

European Search Report, EP Patent Application No. 21165680.6 dated Oct. 6, 2021.

International Search Report and Written Opinion, Application No. PCT/EP2022/058326 dated Jul. 1, 2022.

EP Communication, EP Patent Application No. 21165680.6 dated Aug. 25, 2023.

Office Action in EP Patent Application No. 22718972.7 dated Jun. 12, 2024.

* cited by examiner

METHODS FOR INSTALLING RISERS IN A FLUID INJECTION SYSTEM

TECHNICAL FIELD

The present invention relates generally to strategies for reducing the amount of environmentally unfriendly gaseous components in the atmosphere. Especially, the invention relates to methods for installing a raiser in a fluid injection system for injecting fluid from a vessel on a water surface into a subterranean void beneath a seabed via a subsea template on the seabed. Thus, environmentally unfriendly fluids can be long-term stored in the subterranean void.

BACKGROUND

Carbon dioxide is an important heat-trapping gas, a so-called greenhouse gas, which is released through certain human activities such as deforestation and burning fossil fuels. However, also natural processes, such as respiration and volcanic eruptions generate carbon dioxide.

Today's rapidly increasing concentration of carbon dioxide, $CO_2$, in the Earth's atmosphere is problem that cannot be ignored. Over the last 20 years, the average concentration of carbon dioxide in the atmosphere has increased by 11 percent; and since the beginning of the Industrial Age, the increase is 47 percent. This is more than what had happened naturally over a 20000 year period—from the Last Glacial Maximum to 1850.

Various technologies exist to reduce the amount of carbon dioxide produced by human activities, such as renewable energy production. There are also technical solutions for capturing carbon dioxide from the atmosphere and storing it on a long term/permanent basis in subterranean reservoirs.

For practical reasons, most of these reservoirs are located under mainland areas, for example in the U.S.A. and in Algeria, where the In Salah CCS (carbon dioxide capture and storage system) was located. However, there are also a few examples of offshore injection sites, represented by the Sleipner and Snøhvit sites in the North Sea. At the Sleipner site, $CO_2$ is injected from a bottom fixed platform. At the Snøhvit site, $CO_2$ from LNG (Liquefied natural gas) production is transported through a 153 km long 8 inch pipeline on the seabed and is injected from a subsea template into the subsurface below a water bearing reservoir zone as described inter alia in Shi, J-Q, et al., "Snøhvit $CO_2$ storage project: Assessment of $CO_2$ injection performance through history matching of the injection well pressure over a 32-months period", Energy Procedia 37 (2013) 3267-3274. The article, Eiken, O., et al., "Lessons Learned from 14 years of CCS Operations: Sleipner, In Salah and Snøhvit", Energy Procedia 4 (2011) 5541-5548 gives an overview of the experience gained from three $CO_2$ injection sites: Sleipner (14 years of injection), In Salah (6 years of injection) and Snøhvit (2 years of injection).

The Snøhvit site is characterized by having the utilities for the subsea $CO_2$ wells and template onshore. This means that for example the chemicals, the hydraulic fluid, the power source and all the controls and safety systems are located remote from the place where $CO_2$ is injected. This may be convenient in many ways. However, the utilities and power must be transported to the seabed location via long pipelines and high voltage power cables respectively. The communications for the control and safety systems are provided through a fiber-optic cable. The $CO_2$ gas is pressurized onshore and transported through a pipeline directly to a well head in a subsea template on the seabed, and then fed further down the well into the reservoir. This renders the system design highly inflexible because it is very costly to relocate the injection point should the original site fail for some reason. In fact, this is what happened at the Snøhvit site, where there was an unexpected pressure build up, and a new well had to be established.

As an alternative to the remote-control implemented in the Snøhvit project, the prior art teaches that $CO_2$ may be transported to an injection site via surface ships in the form of so-called type C vessels, which are semi refrigerated vessels. Type C vessels may also be used to transport liquid petroleum gas, ammonia, and other products.

In a type C vessel, the pressure varies from 5 to 18 Barg. Due to constraints in tank design, the tank volumes are generally smaller for the higher pressure levels. The tanks used have a cold temperature as low as −55 degrees Celsius. The smaller quantities of $CO_2$ typically being transported today are held at 15 to 18 Barg and −22 to −28 degrees Celsius. Larger volumes of $CO_2$ may be transported by ship under the conditions: 6 to 7 Barg and −50 degrees Celsius, which enables use of the largest type C vessels. See e.g. Haugen, H. A., et al., "13th International Conference on Greenhouse Gas Control Technologies, GHGT-13, 14-18—November 2016, Lausanne, Switzerland Commercial capture and transport of $CO_2$ from production of ammonia", Energy Procedia 114 (2017) 6133-6140.

In the existing implementations, it is generally understood that a stand-alone offshore injection site requires a floating installation or a bottom fixed marine installation. Such installations provide utilities, power and control systems directly to the wellhead platforms or subsea wellhead installations. It is not unusual, however, that power is provided from shore via high-voltage AC cables.

As exemplified below, the prior art displays various solutions for interconnecting subsea units to enable transport of fluid between these units.

U.S. Pat. No. 9,631,438 shows a connector for connecting components of a subsea conduit system extending between a wellhead and a surface structure, for example, a riser system. Male and female components are provided, and a latching device to releasably latch the male and female components together when the two are engaged. The male and female components incorporate a main sealing device to seal the male and female components together to contain the high pressure wellbore fluids passing between them when the male and female components are engaged. The latching device also incorporates a second sealing device configured to contain fluids when the male and the female components are disengaged, so that during disconnection, any fluids escaping the inner conduit are contained.

U.S. Pat. No. 9,784,044 discloses a connector for a riser equipped with an external locking collar. Here, a locking collar cooperates with a male flange of a male connector element and a female flange of a female connector element by means of a series of tendons. A riser including several sections assembled by a connector is also disclosed.

US 2011/0017465 teaches a riser system including: at least one riser for extending from infrastructure on a sea bed and each riser having a riser termination; an end support restrained above and relative to the sea bed and having attachment means to couple each riser termination for storage and decouple each riser termination for coupling to a floating vessel; and an intermediate support supporting an intermediate portion of the riser to define a catenary bend between the intermediate support and the riser termination device.

Thus, different solutions are known, which enable vessels to create fluid connections with various subsea units. However, there is yet no efficient, safe and reliable means of connecting risers between an offloading buoy and a template on the seabed, such that environmentally unfriendly fluids can be offloaded from a vessel at the buoy, and be transported via the risers to the template for injection into a subterranean reservoir beneath the seabed.

SUMMARY

The object of the present invention is therefore to offer a solution that mitigates the above problems and offers an efficient and reliable system for injecting environmentally harmful fluids for long term storage in subterranean voids beneath the seabed.

According to one aspect of the invention, the object is achieved by a method of attaching a riser to a buoy, which buoy and riser are to be arranged for injecting fluid from a vessel on a water surface into a subterranean void beneath a seabed. The method involves:

- controlling a remote operated vehicle to attach a winch wire to a head end of the riser;
- controlling the remote operated vehicle to lead the winch wire via the buoy to a winch unit on a seabed below the buoy;
- controlling the winch unit to pull up the head end of the riser to a bottom side of the buoy; and
- controlling the remote operated vehicle to connect the head end of the riser to a connector arrangement in the bottom of the buoy.

This method is advantageous because it enables attaching a riser to a buoy in a swift and convenient manner.

According to another aspect of the invention, the object is achieved by a method of attaching a riser to a subsea template on a seabed, which riser is connected to a buoy for receiving fluid from a vessel on a water surface, and which riser is to be arranged for feeding the received fluid to the subsea template for injection into a subterranean void beneath a seabed. The method involves:

- controlling an ROV to steer an emitting end of a base section of the riser to a template guide member on the subsea template;
- controlling the ROV to feed the emitting end of the base section of the riser via the template guide member to a sleeve member having penetration means configured to penetrate the riser so as to cause the penetration means to penetrate the riser in the second end of the base section and create an opening in the riser, and
- controlling the ROV to connect the sleeve member to an injection valve tree comprised in the subsea template, which injection valve tree is in fluid connection with a wellhead for a drill hole to the subterranean void.

This method is advantageous because it enables attaching a riser to a subsea template in a swift and convenient manner.

Further advantages, beneficial features and applications of the present invention will be apparent from the following description and the dependent claims.

BRIEF DESCRIPTION OF THE DRAWINGS

The invention is now to be explained more closely by means of preferred embodiments, which are disclosed as examples, and with reference to the attached drawings.

DETAILED DESCRIPTION

Figure 1:
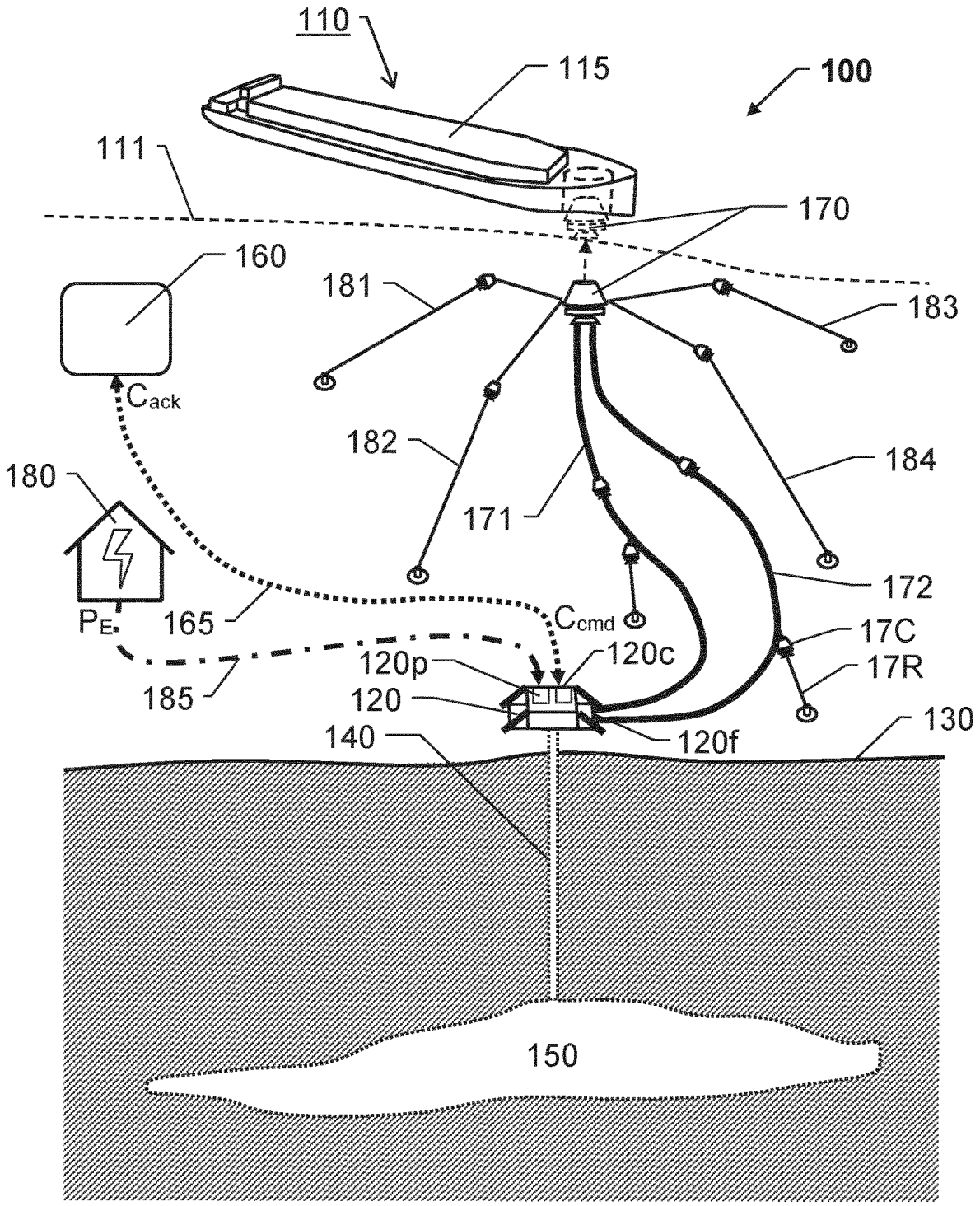
FIG. 1 schematically illustrates a system for long term storage of fluids in a subterranean void according to one embodiment of the invention.

In FIG. 1, we see a schematic illustration of a system according to one embodiment of the invention for long term storage of fluids, e.g. carbon dioxide, in a subterranean void or other accommodation space 150, which typically is a subterranean aquifer. However, according to the invention, the subterranean void 150 may equally well be a reservoir containing gas and/or oil, a depleted gas and/or oil reservoir, a carbon dioxide storage/disposal reservoir, or a combination thereof. These subterranean accommodation spaces are typically located in porous or fractured rock formations, which for example may be sandstones, carbonates, or fractured shales, igneous or metamorphic rocks.

The system includes at least one offshore injection site 100, which is configured to receive fluid, e.g. in a liquid phase, from at least one fluid tank 115 of a vessel 110. The offshore injection site 100, in turn, contains a subsea template 120 arranged on a seabed/sea bottom 130. The subsea template 120 is located at a wellhead for a drill hole 140 to the subterranean void 150. The subsea template 140 may also contain a utility system configured to cause the fluid from the vessel 110 to be injected into the subterranean void 150 in response to control commands $C_{cmd}$. In other words, the utility system is not located onshore, which is advantageous for logistic reasons. For example therefore, in contrast to the above-mentioned Snøhvit site, there is no need for any umbilicals or similar kinds of conduits to provide supplies to the utility system.

The utility system in the subsea template 120 may contain at least one storage tank. The at least one storage tank holds at least one assisting liquid, which is configured to facilitate at least one function associated with injecting the fluid into the subterranean void 150. The at least one assisting liquid contains a de-hydrating liquid and/or an anti-freezing liquid.

In FIG. 1, a control site, generically identified as 160, is adapted to generate the control commands $C_{cmd}$ for controlling the flow of fluid from the vessel 110 and down into the subterranean void 150. For example, the control commands $C_{cmd}$ may relate to opening and closure of valves when the vessel 110 connects to and disconnects from the buoy 170. The control site 160 is positioned at a location geographically separated from the offshore injection site 100, for example in a control room onshore. However, additionally or alternatively, the control site 160 may be positioned at an offshore location geographically separated from the offshore injection site, for example at another offshore injection site.

Consequently, a single control site 160 can control multiple offshore injection sites 100. There is also large room for varying which control site 160 controls which offshore injection site 100. Communications and controls are thus located remote from the offshore injection site 100. However, as will be discussed below, the offshore injection site 100 may be powered locally, remotely or both.

In order to enable remote control from the control site 160, the subsea template 120 preferably contains a communication interface 120*c* that is communicatively connected to the control site 160. The subsea template 120 is also configured to receive the control commands $C_{cmd}$ via the communication interface 120*c*.

Depending on the channel(s) used for forwarding the control commands $C_{cmd}$ between the control site 160 and the offshore injection site 100, the communication interface 120*c* may be configured to receive the control commands $C_{cmd}$ via a submerged fiber-optic and/or copper cable 165, a terrestrial radio link (not shown) and/or a satellite link (not shown). In the latter two cases, the communication interface 120*c* includes at least one antenna arranged above the water surface 111.

Preferably, the communicative connection between the control site 160 and the subsea template 120 is bi-directional, so that for example acknowledge messages $C_{ack}$ may be returned to the control site 160 from the subsea template 120.

According to the invention, the offshore injection site 100 includes a buoy 170, for instance of submerged turret loading (STL) type. When inactive, the buoy 170 may be submerged to 30-50 meters depth, and when the vessel 110 approaches the offshore injection site 100 to offload fluid, the buoy 170 and at least one injection riser 171 and 172 connected thereto are elevated to the water surface 111. After that the vessel 110 has been positioned over the buoy 170, this unit is configured to be connected to the vessel 110 and receive the fluid from the vessel's fluid tank(s) 115, for example via a swivel assembly in the buoy 170. The buoy 170 is preferably anchored to the seabed 130 via one or more hold-back clamps 181, 182, 183 and 184, which enable the buoy 170 to elevated and lowered in the water.

Each of the injection risers 171 and 172 respectively is configured to forward the fluid from the buoy 170 to the subsea template 120, which, in turn, is configured to pass the fluid on via the wellhead and the drill hole 140 down to the subterranean void 150.

According to one embodiment of the invention, the subsea template 120 contains a power input interface 120*p*, which is configured to receive electric energy $P_E$ for operating the utility system and/or operating various functions in the buoy 170. The power input interface 120*p* may be also configured to receive the electric energy $P_E$ to be used in connection with operating a well at the wellhead, a safety barrier element of the subsea template 120 and/or a remotely operated vehicle (ROV) stationed on the seabed 130 at the subsea template 120.

FIG. 1 illustrates a generic power source 180, which is configured to supply the electric power $P_E$ to the power input interface 120*p*. It is generally advantageous if the electric power $P_E$ is supplied via a cable 185 from the power source 180 in the form of low-power direct current (DC) in the range of 200V-1000V, preferably around 400V. The power source 180 may either be co-located with the offshore injection site 100, for instance as a wind turbine, a solar panel and/or a wave energy converter; and/or be positioned at an onshore site and/or at another offshore site geographically separated from the offshore injection site 100. Thus, there is a good potential for flexibility and redundancy with respect to the energy supply for the offshore injection site 100.

The subsea template 120 contains a valve system that is configured to control the injection of the fluid into the subterranean void 150. The valve system, as such, may be operated by hydraulic means, electric means or a combination thereof. The subsea template 120 preferably also includes at least one battery configured to store electric energy for use by the valve system as a backup to the electric energy $P_E$ received directly via the power input interface 120*p*. More precisely, if the valve system is hydraulically operated, the subsea template 120 contains a hydraulic pressure unit (HPU) configured to supply pressurized hydraulic fluid for operation of the valve system. For example, the HPU may supply the pressurized hydraulic fluid through a hydraulic small-bore piping system. The at least one battery is here configured to store electric backup energy for use by the hydraulic power unit and the valve system.

Alternatively, or additionally, the valve operations may also be operated using an electrical wiring system and electrically controlled valve actuators. In such a case, the subsea template 120 contains an electrical wiring system configured to operate the valve system by means of electrical control signals. Here, the at least one battery is configured to store electric backup energy for use by the electrical wiring system and the valve system.

Consequently, the valve system may be operated also if there is a temporary outage in the electric power supply to the offshore injection site. This, in turn, increases the overall reliability of the system.

Locating the utility system at the subsea template 120 in combination with the proposed remote control from the control site 160 avoids the need for offshore floating installations as well as permanent offshore marine installations. The invention allows direct injection from relatively uncomplicated maritime vessels 110. These factors render the system according to the invention very cost efficient.

According to the invention, further cost savings can be made by avoiding the complex offshore legislation and regulations. Namely, a permanent offshore installation acting as a field center for an offshore field development is bound by offshore legislation and regulations. There are strict safety requirements related to well control especially. For instance, offshore Norway, it is stipulated that floating offshore installations, permanent or temporary, that control well barriers must satisfy the dynamic positioning level 3 (DP3) requirement. This involves extensive requirements in to ensure that the floater remains in position also during extreme events like engine room fires, etc. Nevertheless, the vessel 110 according to the invention does not need to provide any utilities, well or barrier control, for the injection system. Consequently, the vessel 110 may operate under maritime legislation and regulations, which are normally far less restrictive than the offshore legislation and regulations.

Figure 2:
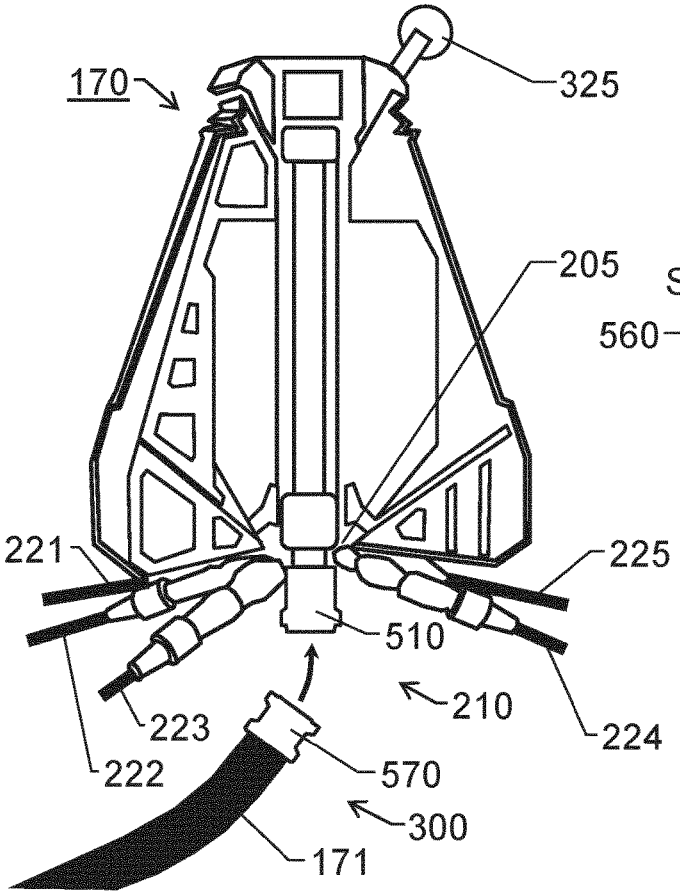
FIG. 2 shows a buoy configured to connect a vessel to a fluid-transporting riser according to one embodiment of the invention.

FIG. 2 shows a buoy 170 according to one embodiment of the invention that is configured to enable a vessel, e.g. 110 shown in FIG. 1, to connect to the fluid-transporting riser 171, which, in turn, is connected to the subsea template 120 in further fluid connection with the subterranean void 150.

Referring again to FIG. 1, we see a fluid injection system arranged to receive fluid, e.g. containing $CO_2$, from the vessel 110. The fluid injection system contains the buoy 170 configured to be connected with the vessel 111 and receive the fluid therefrom. The system also contains the subsea template 120, which is located on the seabed 130 at the wellhead for the drill hole 140 to the subterranean void 150.

Moreover, the system includes at least one riser, here exemplified by 171 and 172 respectively, which interconnect the buoy 170 and the subsea template 120. Each of the at least one riser 171 and 172 is configured to transport the fluid from the buoy 170 to the subsea template 120.

Figure 5:
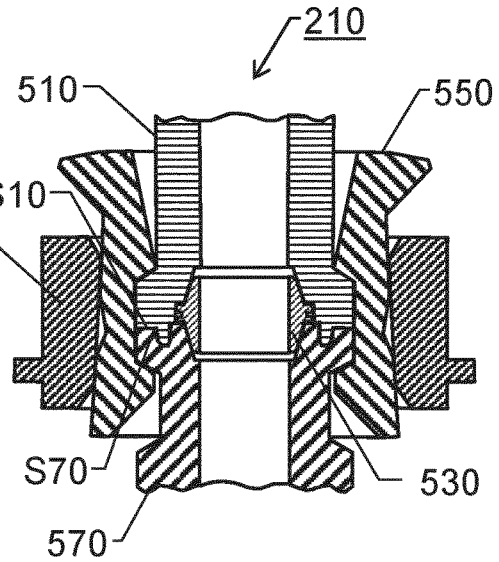
FIG. 5 illustrates a connector arrangement for connecting the riser to the buoy according to one embodiment of the invention.

Specifically, each of the at least one riser 171 and 172 is detachably connected to a bottom surface of the buoy 170 by means of a connector arrangement 210. FIG. 5 illustrates the connector arrangement 210 according to one embodiment of the invention, which connector arrangement 210 is configured to connect the riser 171 to the buoy 170. Naturally, although not illustrated in FIG. 2, any additional risers attached to the buoy 170 will be connected in an analogous manner.

The connector arrangement 210 includes a buoy guide member 510 configured to automatically steer a connector member 570 towards the buoy guide member 510 when the connector member 570 is moved towards the buoy guide member 510. The connector member 570 is attached in a head end 300 of the riser 171 to be connected to the buoy 170. The connector arrangement 210 further includes a mating member 550, for example embodied as so-called fingers, configured to attach a first sealing surface S70 of the connector member 570 to a second sealing surface S10 of the buoy guide member 510 when said head end 300 has been moved such that the connector member 570 contacts the buoy guide member 510. Additionally, the connector arrangement 210 includes a locking member 560 configured to lock the first and second sealing surfaces S70 and S10 to one another when these surfaces are aligned with one another.

Preferably, the connector arrangement 210 contains one collet connector for each riser to be connected to the buoy 170. In addition to the elements mentioned above, the collet connector typically also includes a seal gasket 530, which is arranged between the first and second sealing surfaces S70 and S10 to further reduce the risk of leakages.

Figure 3A:
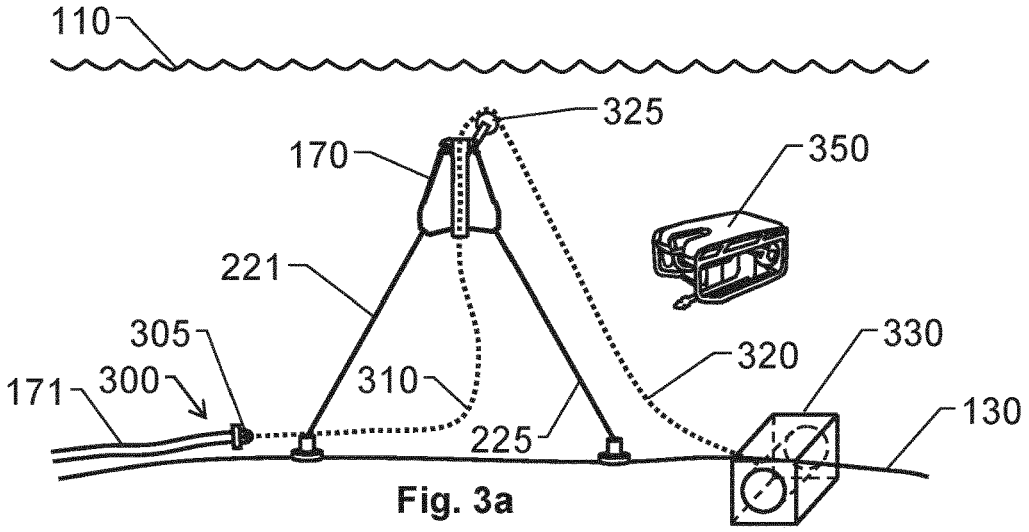
FIGS. 3*a-c* illustrate how a riser is connected to a buoy according to one embodiment of the invention.
Figure 3B:
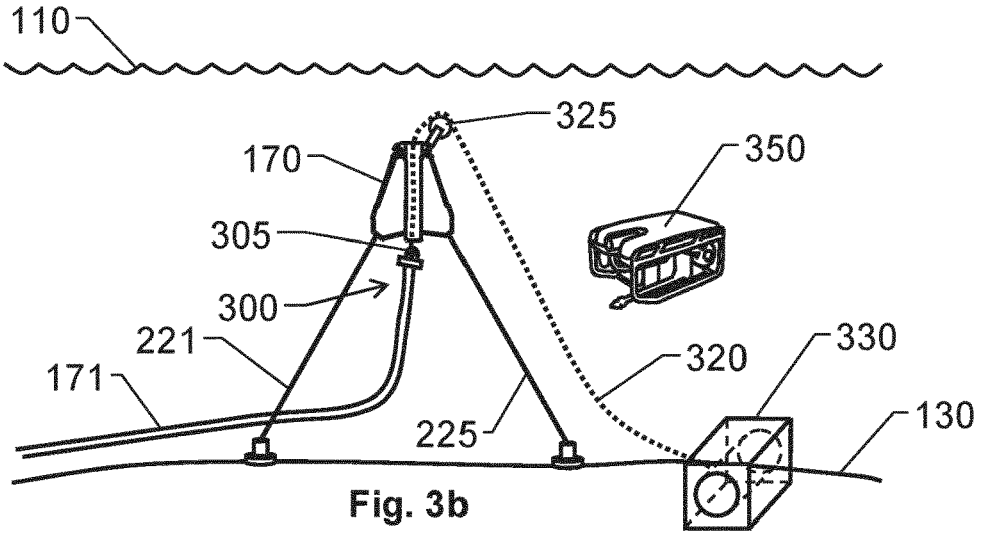
Figure 3C:
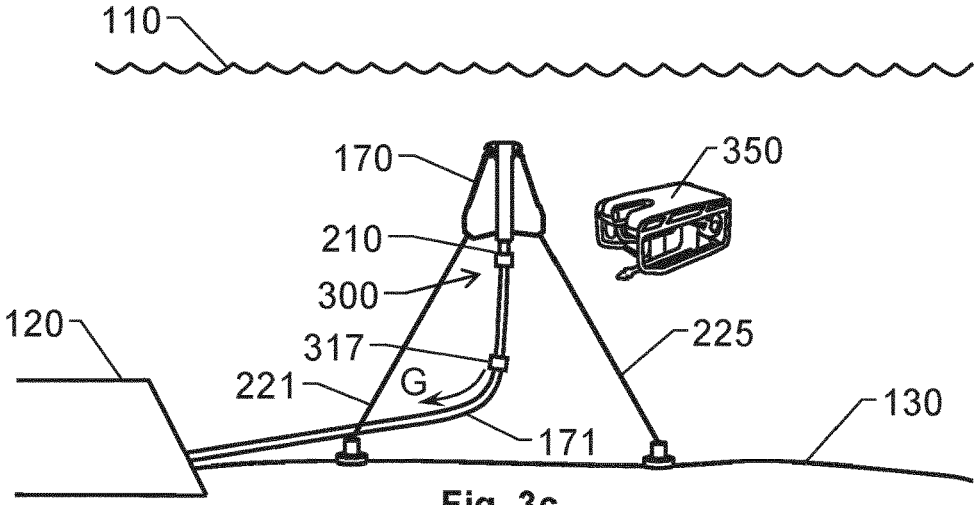

FIGS. 3*a*, 3*b* and 3*c* illustrate how a riser 171 is connected to a buoy 170 according to one embodiment of the invention.

Here, the head end 300 of the riser 171 to be connected contains a plug member 317 covering the first sealing surface S70. Thus, water is and prevented from entering into the riser 171 before the riser 171 has been connected to the buoy 170. In addition to that, the head end 300 of the riser 171 to be connected preferably includes a drag-eye member 305, which facilitates connecting a winch wire to the head end 300 and pulling the riser 171 up to the buoy 170 as described below.

As illustrated in FIG. 3*c*, according to one embodiment of the invention, the plug member 317 is configured to encircle the riser 171 to be connected to the buoy 170. After that the plug member 317 has been disconnected from the head end 300 of the riser 171, the plug member 317 is further configured to be transported by gravity G down along said riser 171 towards the subsea template 120.

Referring now to FIG. 3*a*, according to one embodiment of the invention, the fluid injection system contains a winch unit 330, which is arranged on the seabed 130. The winch unit 330 is configured to pull up the head end 300 of the riser 171 to be connected to the buoy 170 via a winch wire 320 connected between the head end 300 of the riser 171 and the winch unit 330. The which wire 320 runs via the buoy 170 to the winch unit 330. Preferably, the winch wire 320 is led through the buoy 170 and via at least one sheave wheel 325 on the buoy 170 as illustrated in FIGS. 3*a* and 3*b*.

Preferably, the fluid injection system includes an ROV 350 that is configured to be remote controlled to attach the winch wire 320 to the head end 300 of the riser 171. Further preferably, the ROV 350 is configured to disconnect the plug member 317 from the first sealing surface S70 of the connector member 570 in the head end 300 of the riser 171; and thereafter, connect the riser 171 to the buoy 170.

According to one embodiment of the invention, the buoy 170 contains at least one connector arrangement in addition to the above-mentioned connector arrangement 210, which at least one additional connector arrangement is configured to connect a respective riser to the buoy 170. Thus, for example a second riser 172 can be connected between the buoy 170 and the subsea template 120 as illustrated in FIG. 1.

Specifically therefore, according to one embodiment of the invention, a method involves controlling the ROV 350 to attach the winch wire 320 to a head end 300 of a second riser 172; controlling the ROV 350 to lead the winch wire 320 via the buoy 170 to the winch unit 330 on the seabed 130 below the buoy 170. Thereafter, method involves controlling the winch unit 330 to pull up the head end 300 of the second riser 172 to the bottom side of the buoy 170. Subsequently, the ROV 350 is controlled to connect the head end 300 of the second riser 172 to a second connector arrangement 210 in the bottom of the buoy 170.

Figure 6:
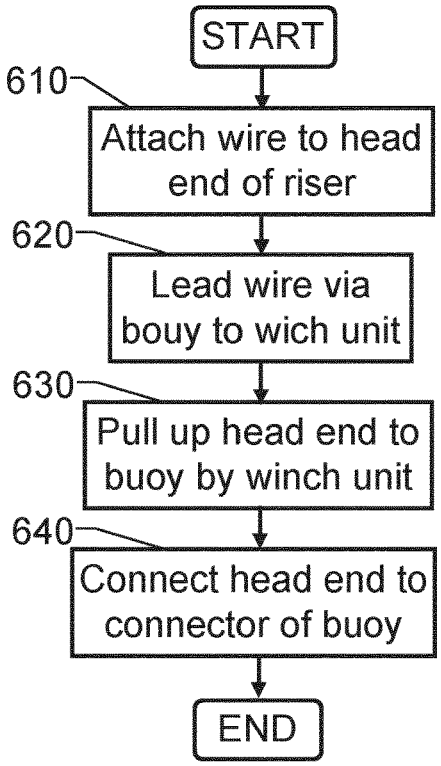
FIG. 6 illustrates, by means of a flow diagram a method according to one embodiment of the invention for connecting a riser to a buoy.

Referring now to the flow diagram of FIG. 6, we will describe a method for connecting the riser 171 to the buoy 170 by using the ROV 350 according to one embodiment of the invention.

In a first step 610, the ROV 350 is controlled to attach the winch wire 320 to the head end 300 of the riser 171.

Then, in a step 620, the ROV 350 is controlled to lead the winch wire 320 via the buoy 170 to the winch unit 330 on the seabed 130 below the buoy 170.

Subsequently, in a step 630, the winch unit 330 is controlled to pull up the head end 300 of the riser (171) to a bottom side of the buoy 170.

Finally, in a step 640 thereafter, the ROV 350 is controlled to connect the head end 300 of the riser 171 to the connector arrangement 210 in the bottom of the buoy 170.

Figure 4A:
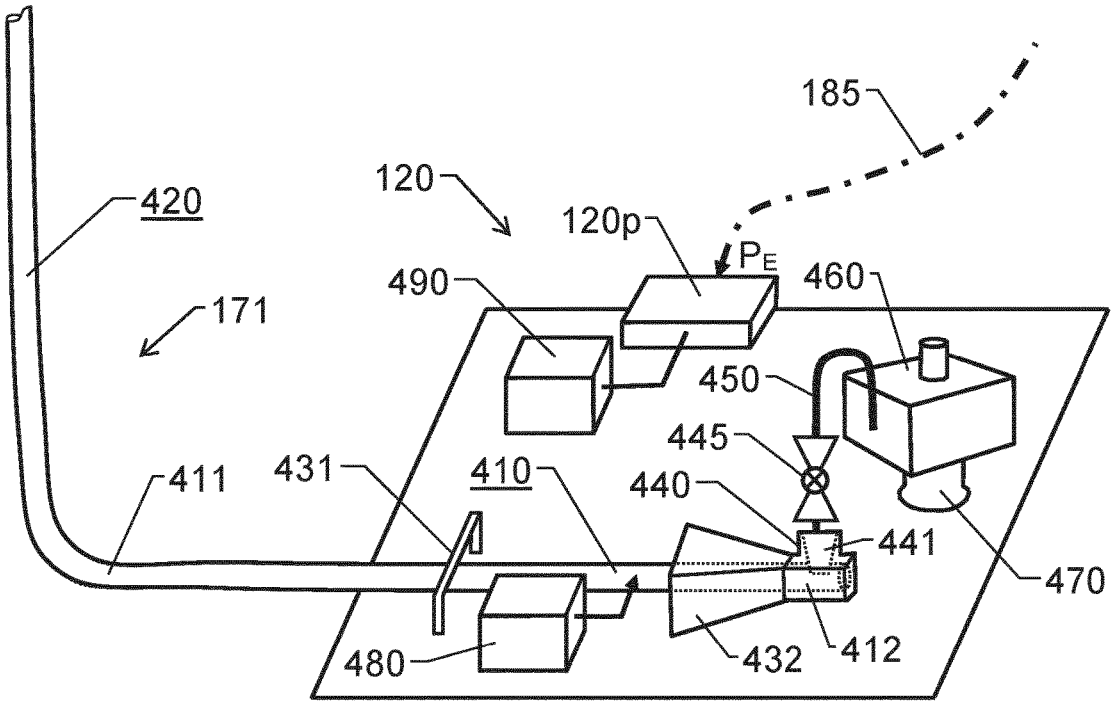
FIGS. 4*a-c* schematically illustrate an interior of a subsea template according to embodiments of the invention.

FIG. 4*a* schematically illustrates an interior of a subsea template 220 according to one embodiment of the invention. Here, an exemplary riser 171 is shown, which has a base section 410 and an upright section 420. The upright section 420 constitutes an uppermost part, which is further connected to the buoy 170. The base section 410 constitutes a lowermost part of the riser 171, which, in a receiving end 411, is connected to the upright section 420; and in an emitting end 412, is connected to the subsea template 120.

As illustrated in FIG. 1, it is desirable if each of the risers 171 and 172 contains a holdback clamp 17C, which is configured to hold the base section 410 of the riser in a desired position via a restraining riser 17R attached to the seabed 130.

According to one embodiment of the invention, the subsea template 120 contains an injection valve tree 460, which is in fluid connection with the wellhead 470 for the drill hole 140. The subsea template 120 also contains a sleeve member 440 having penetration means 441, e.g. represented by a pipe-piece extending substantially orthogonally relative to an extension of the sleeve member 440, which penetration means 441 is configured to penetrate the riser 171 in the emitting end 412 of the base section 410. As a result, when the emitting end 412 of the base section 410 is inserted into the sleeve member 440 the penetration means 441 will create an opening in the riser 171. This opening, in turn, is connectable to the injection valve tree 460.

Preferably, a vertical connector extending from the penetration means 441 has a relatively large tolerance for deviation, say allowing up to 5-10 degrees misalignment. Namely, this allows for a useful flexibility when installing the riser 171 in the subsea template 120. Tolerance budgets are estimated based upon accuracy of fabrication, assembly and installation, and flexibility in the piping and misalignment acceptance in the connectors used.

It is preferable if the sleeve member 440 contains, or is associated with, at least one guide member, which is exemplified by 432 in FIG. 4. The guide member 440 is shaped and arranged relative to the penetration means 441 so as to steer the emitting end 412 of the base section 410 towards the penetration means 441 to allow the emitting end 412 of the base section 410 to land down at a certain speed and provide a finer and finer alignment with the penetration means 441. Thus, for example, the guide member 432 may have a general funnel shape converging towards the penetration means 441. Thereby, the guide member 432 is configured to steer the emitting end 412 of the base section 410 towards the sleeve member when the emitting end 412 of the base section 410 is brought towards the subsea template 120.

It is preferable if the subsea template 120 contains a clamping member 431 arranged to hold down the base section 410 so that it is kept parallel to the seabed 130.

Figure 4B:
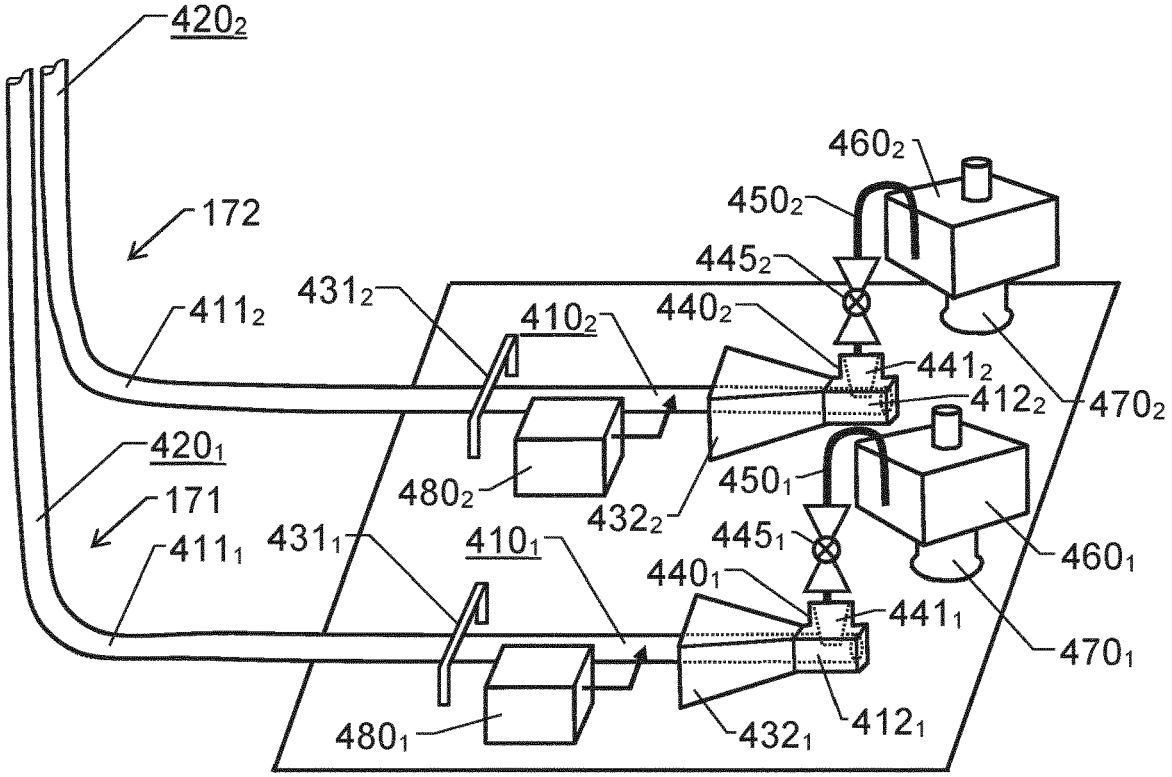

FIG. 4*b* schematically illustrates an interior of the subsea template 220 according to another embodiment of the invention. In FIG. 4*b*, components/units bearing reference numbers that also occur in FIG. 4*a* designate the components/units described above with reference to FIG. 4*a*. To simplify the drawing, none of the power interface 120*p*, the electric power line 185 or the battery 490 is illustrated in FIG. 4*b*. However, of course, preferably also these components/units are included also in this embodiment of the invention.

FIG. 4*b* shows a subsea template 120 with dual wellheads $\mathbf{470}_1$ and $\mathbf{470}_2$ respectively, which basically doubles the capacity per unit time for receiving fluid from one or more vessels 110. The subsea template 120 further has specific fluid-feeding components and units for each of the wellheads $\mathbf{470}_1$ and $\mathbf{470}_2$.

Here, after connecting the first riser 171 as described above with reference to FIG. 4*a*, a second riser 172 is connected to the subsea template 120 as follows. The ROV 350 is controlled to steer an emitting end $\mathbf{412}_2$ of a base section $\mathbf{410}_2$ of the second riser 172 to a second template guide member $\mathbf{432}_2$ on the subsea template 120. Then, the ROV is controlled to feed the emitting end $\mathbf{412}_2$ of the base section $\mathbf{410}_2$ of the second riser 172 via the second template guide member $\mathbf{432}_2$ to a second sleeve member $\mathbf{440}_2$ having second penetration means $\mathbf{441}_2$ configured to penetrate the second riser 172) so as to cause the second penetration means $\mathbf{441}_2$ to penetrate the second riser 172 in the emitting end $\mathbf{412}_2$ of the base section $\mathbf{410}_2$ and create a first opening in the second riser 172. Thereafter, the ROV 350 is controlled to connect the second sleeve member $\mathbf{440}_2$ to a second injection valve tree $\mathbf{460}_2$ of the subsea template 120. The second injection valve tree $\mathbf{460}_2$, in turn, is in fluid connection with a second wellhead $\mathbf{470}_2$ for the drill hole 140 to the subterranean void 150. Thus, the second riser 172 may pass fluid into the subterranean void 150.

Figure 4C:
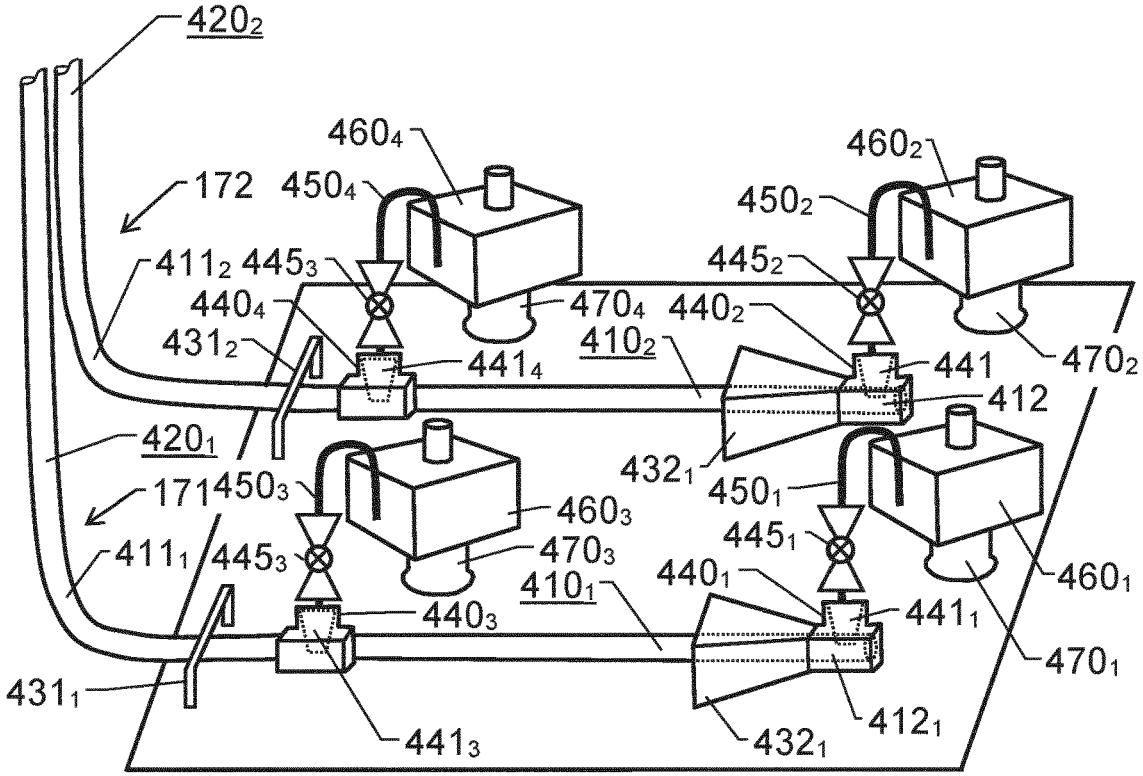

FIG. 4*c* schematically illustrates an interior of the subsea template 220 according to yet another embodiment of the invention. In FIG. 4*c*, components/units bearing reference numbers that also occur in any of FIG. 4*a* or 4*b* designate the components/units described above with reference to FIGS. 4*a* and 4*b*. In FIG. 4*c*, to simplify the drawing, none of the power interface 120*p*, the electric power line 185, the battery 490 or any heating units 480 is illustrated. However, of course, preferably also these components/units are included also in this embodiment of the invention.

FIG. 4*c* shows a subsea template 120 with four wellheads $\mathbf{470}_1$, $\mathbf{470}_2$, $\mathbf{470}_3$ and $\mathbf{470}_4$, which basically quadruples the capacity per unit time for receiving fluid from one or more vessels 110. The subsea template 120 further has specific fluid-feeding components and units for each of the wellheads $\mathbf{470}_1$, $\mathbf{470}_2$, $\mathbf{470}_3$ and $\mathbf{470}_4$ respectively.

Here, after connecting the first and second risers 171 and 172 as described above with reference to FIG. 4*b*, the following procedure is performed. The ROV is controlled to steer the first riser 171 against a third penetration means $\mathbf{441}_3$ of a third sleeve member $\mathbf{440}_3$. The third penetration means $\mathbf{441}_3$ is configured to penetrate the first riser 171 so as to cause the third penetration means $\mathbf{441}_3$ to penetrate the base section $\mathbf{410}_1$ of the first riser 171 and create a second opening in the first riser 171. Then, the ROV 350 is controlled to connect the third sleeve member $\mathbf{440}_3$ to a third injection valve tree $\mathbf{460}_3$ comprised in the subsea template 120. The third injection valve tree $\mathbf{460}_3$ is in fluid connection with the third wellhead $\mathbf{470}_3$ for the drill hole 140 to the subterranean void 150.

Subsequently, the ROV 350 is controlled to steer the second riser 172 against a fourth penetration means $\mathbf{441}_4$ of a fourth sleeve member $\mathbf{440}_4$. The fourth penetration means $\mathbf{441}_4$ is configured to penetrate the second riser 172 so as to cause the fourth penetration means $\mathbf{441}_4$ to penetrate the base section $\mathbf{410}_2$ of the second riser 172 and create a second opening in the second riser 172. After that, the ROV 350 is controlled to connect the fourth sleeve member $\mathbf{440}_4$ to a fourth injection valve tree $\mathbf{460}_4$ in the subsea template 120. The fourth injection valve tree $\mathbf{460}_4$, in turn, is in fluid connection with a fourth wellhead $\mathbf{470}_4$ for a drill hole 140 to the subterranean void 150.

Preferably, in each of the embodiments illustrated in FIGS. 4*b* and 4*c* the subsea template 120 contains respective clamping members $\mathbf{431}_1$ and $\mathbf{431}_2$ arranged to hold down the base sections $\mathbf{410}_1$ and $\mathbf{410}_2$ of the first and second risers 171 and 172 respectively so that the base sections $\mathbf{410}_1$ and $\mathbf{410}_2$ are kept parallel to the seabed 130.

Figure 7:
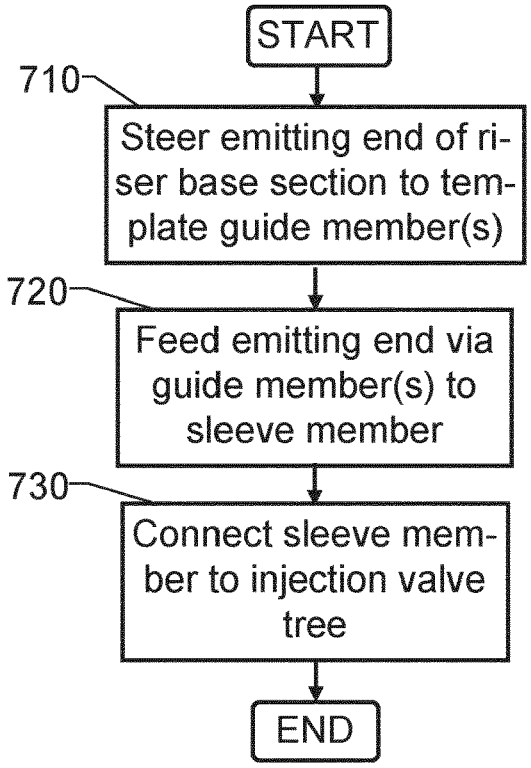
FIG. 7 illustrates, by means of a flow diagram a method according to one embodiment of the invention for connecting a riser to a subsea template.

Referring now to the flow diagram of FIG. 7, we will describe a method for connecting the riser 171 to the subsea template 120 according to one embodiment of the invention by using the ROV 350.

In a first step 710, the ROV 350 is controlled to steer the emitting end 412 of the base section 410 of the riser 171 to the template guide member 432 on the subsea template 120.

Thereafter, in a step 720, the ROV 350 is controlled to feed the emitting end 412 of the base section 410 of the riser 171 via the template guide member 432 to the sleeve member 440, which has penetration means 441 configured to penetrate the riser 171. Consequently, when the second end 412 of the base section 410 is fed into the sleeve member 440, the penetration means 441 is caused to penetrate the riser 171 in the second end 412 and create an opening in the riser 171.

Finally, in a subsequent step 730, the ROV 350 is controlled to connect the sleeve member 440 to the injection valve tree 460 in the subsea template 120.

According to one embodiment of the invention, the subsea template 120 contains a jumper pipe 450 having a general U-shape, which is configured to establish a fluid connection between the opening in the riser 171 and the injection valve tree 460. An advantage with the jumper pipe 450 exclusively being a pipe element is that can be made flexible enough to meet the tolerance requirements for making successful connection.

However, the jumper pipe 450 may also act as a "injection choke bridge." This means that the jumper pipe 450 includes a choke valve and instrumentation for controlling the injection of the fluid. The jumper pipe 450 is designed with such design tolerances that it is attachable both onto the vertical connector extending from the penetration means 441 and the valve tree 460. Preferably, this connection also includes a valve 445, e.g. of ball or gate type, such that a rate of the fluid flow into the injection valve tree 460 can be regulated, and shut off if needed. It is advantageous if the valve 445 is configured to be operable by the ROV 350.

It is further preferable if the subsea template 120 contains at least one heating unit. In FIG. 4, a generic heating unit 480 is illustrated, which is configured to heat the fluid received from the riser 171 before the fluid is being injected into the subterranean void 150. Thus, for example obstructing fluid plugs can be removed from the base section 410 of the riser 171 in a straightforward manner.

Figure 9:
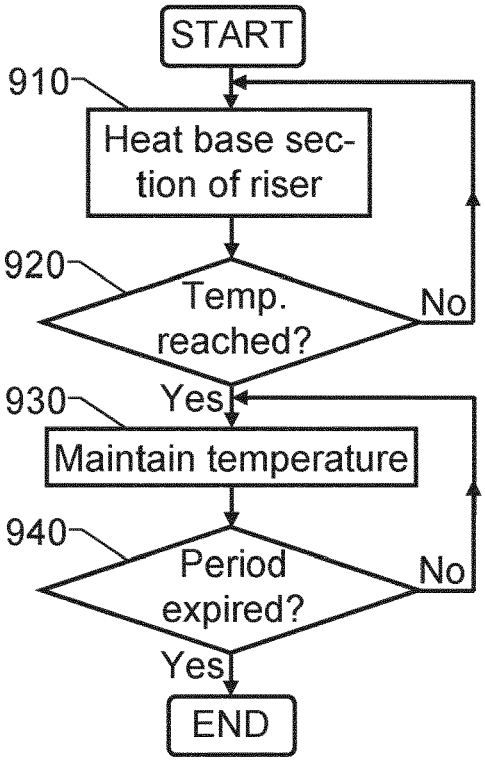

Referring now to the flow diagram of FIG. 9, we will describe such a method. As mentioned above, the base section 410 extends between the receiving end 411 and the emitting end 412 of the riser 171, where the receiving end 411 is connected to the upright section 420 of the riser 171 and the emitting end 412 of the riser 171 is connected to the subsea template 120. The subsea template 120 is further connected to the wellhead (470) for a drill hole 140 to the subterranean void 150 into which fluid received via the riser 171 is to be injected from the subsea template 120.

In a first step 910, the heating unit 480 is controlled to heat at least one portion of the base section 410. A subsequent step 920 checks if the least one portion of the base section 410 has reached a predetermined temperature. If so, a step 930 follows; and otherwise, the procedure loops back to step 910.

In step 930, the heating unit 480 is controlled to maintain a temperature level above or equal to the predetermined temperature in the at least one section of the base section.

Thereafter, a step checks if a heating period has expired. If so, the procedure ends; and otherwise, the procedure loops back to step 930.

Referring again to FIG. 4, according to one embodiment of the invention, the subsea template 120 contains a power interface 120*p* that is configured to receive electric power $P_E$ via an electric power line 185 on the seabed 130, for example from an onshore power source 180. It is also advantageous if the subsea template 120 contains at least one battery 490 configured to provide electric power to at least one unit in the subsea template 120, for instance the heating unit 480, the valve 445 and/or the injection valve tree 460.

Naturally, it is preferable if also the at least one battery 490 is configured to be charged by electric power $P_E$ received via the power interface 120*p*.

In addition to the tasks mentioned above, the ROV 350 is preferably configured to be controlled to effect at least one procedure in connection with controlling the valve 445 in the subsea template 120, controlling one or more valves in the buoy 170 and/or performing maintenance of the fluid injection system.

Figure 8:
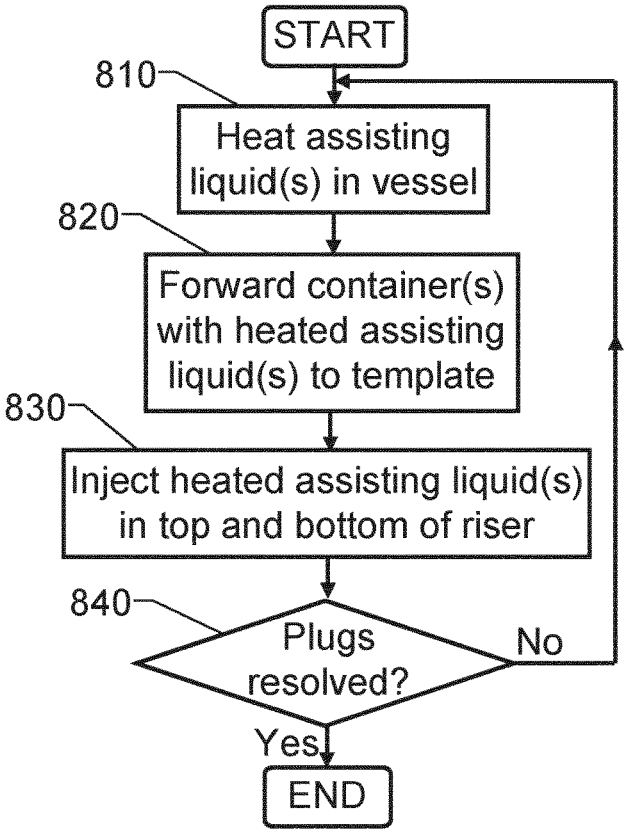
FIGS. 8-9 illustrate, by means of flow diagrams, methods according to first and second embodiments of the invention for removing obstructing fluid plugs in a riser.

FIG. 8 illustrates, by means of a flow diagram, a method for removing obstructing fluid plugs in the riser 171, which is an alternative to the method described above with reference to FIG. 9.

In a first step 810, at least one assisting liquid is heated to a predetermined temperature in the vessel 110.

Thereafter, in a step 820, at least one container holding the at least one heated assisting liquid is/are forwarded from the vessel 110 to a storage container in the subsea template 120.

In a subsequent step 830, the at least one heated assisting liquid is/are injected from the storage container into at least one injection point in the base section 410 of the riser 171, and from the vessel 110 into at least one injection point in the upright section 420 of the riser 171.

Then, in a step 840, it is checked if the plugs in the riser 171 have melted away. If so, the procedure ends; and otherwise, the procedure loops back to step 810.

Variations to the disclosed embodiments can be understood and effected by those skilled in the art in practicing the claimed invention, from a study of the drawings, the disclosure, and the appended claims.

The term "comprises/comprising" when used in this specification is taken to specify the presence of stated features, integers, steps or components. The term does not preclude the presence or addition of one or more additional elements, features, integers, steps or components or groups thereof. The indefinite article "a" or "an" does not exclude a plurality. In the claims, the word "or" is not to be interpreted as an exclusive or (sometimes referred to as "XOR"). On the contrary, expressions such as "A or B" covers all the cases "A and not B", "B and not A" and "A and B", unless otherwise indicated. The mere fact that certain measures are recited in mutually different dependent claims does not indicate that a combination of these measures cannot be used to advantage. Any reference signs in the claims should not be construed as limiting the scope.

It is also to be noted that features from the various embodiments described herein may freely be combined, unless it is explicitly stated that such a combination would be unsuitable.

The invention is not restricted to the described embodiments in the figures, but may be varied freely within the scope of the claims.

The invention claimed is:

1. A method of attaching risers to a buoy, which buoy and risers are to be arranged for injecting fluid from a vessel on a water surface into a subterranean void beneath a seabed, the method comprising:

controlling a remote operated vehicle to attach a winch wire to a head end of a first riser of the risers, controlling the remote operated vehicle to lead the winch wire via the buoy to a winch unit on a seabed below the buoy, controlling the winch unit to pull up the head end of the first riser to a bottom side of the buoy, and controlling the remote operated vehicle to connect the head end of the first riser to a first connector arrangement in the bottom of the buoy.

2. The method according to claim 1, further comprising:

controlling the remote operated vehicle to attach the winch wire to a head end of a second riser of the risers, controlling the remote operated vehicle to lead the winch wire via the buoy to the winch unit on the seabed below the buoy, controlling the winch unit to pull up the head end of the second riser to the bottom side of the buoy, and controlling the remote operated vehicle to connect the head end of the second riser to a second connector arrangement in the bottom of the buoy.

3. A method of attaching risers to a subsea template on a seabed, which risers are connected to a buoy for receiving fluid from a vessel on a water surface, and which risers are to be arranged for feeding the received fluid to the subsea template for injection into a subterranean void beneath a seabed, the method comprising:

controlling a remote operated vehicle to steer an emitting end of a base section of a first riser of the risers to a first template guide member on the subsea template, controlling the remote operated vehicle to feed the emitting end of the base section of the first riser via the first template guide member to a first sleeve member having first penetration means configured to penetrate the first riser so as to cause the first penetration means to penetrate the first riser in the emitting end of the base section and create a first opening in the first riser, and controlling the remote operated vehicle to connect the first sleeve member to a first injection valve tree comprised in the subsea template, which first injection valve tree is in fluid connection with a first wellhead for a drill hole to the subterranean void.

4. The method according to claim 3, wherein the method further comprises:

controlling the remote operated vehicle to steer an emitting end of a base section of a second riser of the risers to a second template guide member on the subsea template, controlling the remote operated vehicle to feed the emitting end of the base section of the second riser via the second template guide member to a second sleeve member having second penetration means configured to penetrate the second riser so as to cause the second penetration means to penetrate the second riser in the emitting end of the base section and create a first opening in the second riser, and controlling the remote operated vehicle to connect the second sleeve member to a second injection valve tree comprised in the subsea template, which second injection valve tree is in fluid connection with a second wellhead for a drill hole to the subterranean void.

5. The method according to claim 4, wherein the method further comprises:

controlling the remote operated vehicle to steer the first riser against a third penetration means of a third sleeve member, which third penetration means is configured to penetrate the first riser so as to cause the third penetration means to penetrate the base section of the first riser and create a second opening in the first riser, and controlling the remote operated vehicle to connect the third sleeve member to a third injection valve tree comprised in the subsea template, which third injection valve tree is in fluid connection with a third wellhead for a drill hole to the subterranean void.

6. The method according to claim 5, wherein the method further comprises:

controlling the remote operated vehicle to steer the second riser against a fourth penetration means of a fourth sleeve member, which fourth penetration means is configured to penetrate the second riser so as to cause the fourth penetration means to penetrate the base section of the second riser and create a second opening in the second riser, and controlling the remote operated vehicle to connect the fourth sleeve member to a fourth injection valve tree comprised in the subsea template, which fourth injection valve tree is in fluid connection with a fourth wellhead for a drill hole to the subterranean void.

* * * * *